US007742728B2

(12) United States Patent
Sato et al.

(10) Patent No.: US 7,742,728 B2
(45) Date of Patent: Jun. 22, 2010

(54) IMAGE FORMING APPARATUS WITH COMPACTLY ARRANGED IMAGE FORMING DEVICES

(75) Inventors: Masahiro Sato, Kanagawa (JP); Atsuyuki Kitamura, Kanagawa (JP); Tsukasa Inao, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 685 days.

(21) Appl. No.: 11/486,049

(22) Filed: Jul. 14, 2006

(65) Prior Publication Data

US 2007/0134026 A1 Jun. 14, 2007

(30) Foreign Application Priority Data

Dec. 13, 2005 (JP) ..... P2005-358817

(51) Int. Cl.
*G03G 15/01* (2006.01)

(52) U.S. Cl. ..... 399/299; 399/300; 399/302; 399/308

(58) Field of Classification Search ..... 399/299, 399/300, 302, 308
See application file for complete search history.

(56) References Cited

U.S. PATENT DOCUMENTS

| | | | | |
|---|---|---|---|---|
| 5,160,946 | A | 11/1992 | Hwang | 346/157 |
| 5,386,286 | A * | 1/1995 | Kinouchi et al. | 399/299 |
| 6,198,890 | B1 | 3/2001 | Liu et al. | 399/107 |
| 6,389,260 | B1 | 5/2002 | Kataoka et al. | 399/298 |
| 7,130,567 | B2 | 10/2006 | Sudo et al. | 399/262 |
| 7,173,646 | B2 | 2/2007 | Nakahata | 347/245 |
| 7,203,452 | B2 | 4/2007 | Miyawaki et al. | 399/299 |
| 2001/0055499 | A1 | 12/2001 | Sato | 399/111 |
| 2002/0031379 | A1 | 3/2002 | Miyawaki et al. | |
| 2002/0041781 | A1 | 4/2002 | Yasui et al. | 399/391 |
| 2002/0110388 | A1 | 8/2002 | Yokomori et al. | 399/167 |
| 2003/0223784 | A1 * | 12/2003 | Yamanaka et al. | 399/303 |
| 2004/0101327 | A1 | 5/2004 | Nomura et al. | 399/111 |
| 2004/0109704 | A1 | 6/2004 | Abe | 399/107 |
| 2004/0126150 | A1 | 7/2004 | Noguchi et al. | 399/299 |
| 2004/0136747 | A1 | 7/2004 | Tanizaki et al. | 399/110 |
| 2004/0165910 | A1 | 8/2004 | Sato et al. | 399/116 |
| 2004/0179869 | A1 | 9/2004 | Miyawaki et al. | |
| 2004/0190932 | A1 | 9/2004 | Ishii | 399/110 |
| 2004/0208670 | A1 | 10/2004 | Abe | 399/110 |
| 2005/0030364 | A1 * | 2/2005 | Sato | 347/115 |

(Continued)

FOREIGN PATENT DOCUMENTS

| | | | |
|---|---|---|---|
| CN | 1327548 | A | 12/2001 |

(Continued)

*Primary Examiner*—David M Gray
*Assistant Examiner*—Ryan D Walsh
(74) *Attorney, Agent, or Firm*—Morgan, Lewis & Bockius LLP

(57) ABSTRACT

An image forming apparatus includes a belt, plural photosensitive drums that face the belt, plural developing devices that develop plural latent images formed on the plural photosensitive drums using a developing agent, where the developing devices are disposed around the respective photosensitive drums, and plural image forming devices, where each one of the plural image forming devices includes one of the plural photosensitive drums and one of the plural developing devices, and the photosensitive drum of an adjacent one of the plural image forming devices is disposed vertically within a horizontal width of the developing device of one of the plural image forming devices.

9 Claims, 4 Drawing Sheets

U.S. PATENT DOCUMENTS

2006/0083545 A1 4/2006 Okabe et al. ..... 399/111

FOREIGN PATENT DOCUMENTS

CN 1372170 10/2002
CN 1484107 A 3/2004
CN 1493931 5/2004
JP 3023374 1/2000
JP 2001-209234 8/2001
JP 2002-148892 5/2002
JP 2002-162807 6/2002
JP 2004-162807 6/2004

* cited by examiner

IMAGE FORMING APPARATUS WITH COMPACTLY ARRANGED IMAGE FORMING DEVICES

BACKGROUND

1. Technical Field

The present invention relates to an image forming apparatus such as a printer, a facsimile, and a copier.

2. Related Art

A tandem system is known as a type of image forming apparatus. The tandem system is such that, for example, four image forming units are disposed parallel to one another around a belt to form a color image. Although the tandem system can achieve high productivity, the apparatus tends to be large in size because four image forming units need to be aligned.

SUMMARY

According to an aspect of the present invention, an image forming apparatus includes a belt, plural photosensitive drums that face the belt, plural developing devices that develop plural latent images formed on the plural photosensitive drums using a developing agent, where the developing devices are disposed around the respective photosensitive drums, and plural image forming devices, where each one of the plural image forming devices includes one of the plural photosensitive drums and one of the plural developing devices, and the photosensitive drum of an adjacent one of the plural image forming devices is disposed vertically within a horizontal width of the developing device of one of the plural image forming devices.

The foregoing belt may be an intermediate transfer belt or may be a conveying belt for conveying sheets.

BRIEF DESCRIPTION OF THE DRAWINGS

Exemplary embodiments of the present invention will be described in detail based on the following figures, wherein.

DETAILED DESCRIPTION

Next, exemplary embodiments of the invention will be described with reference to the drawings.

Figure 1:
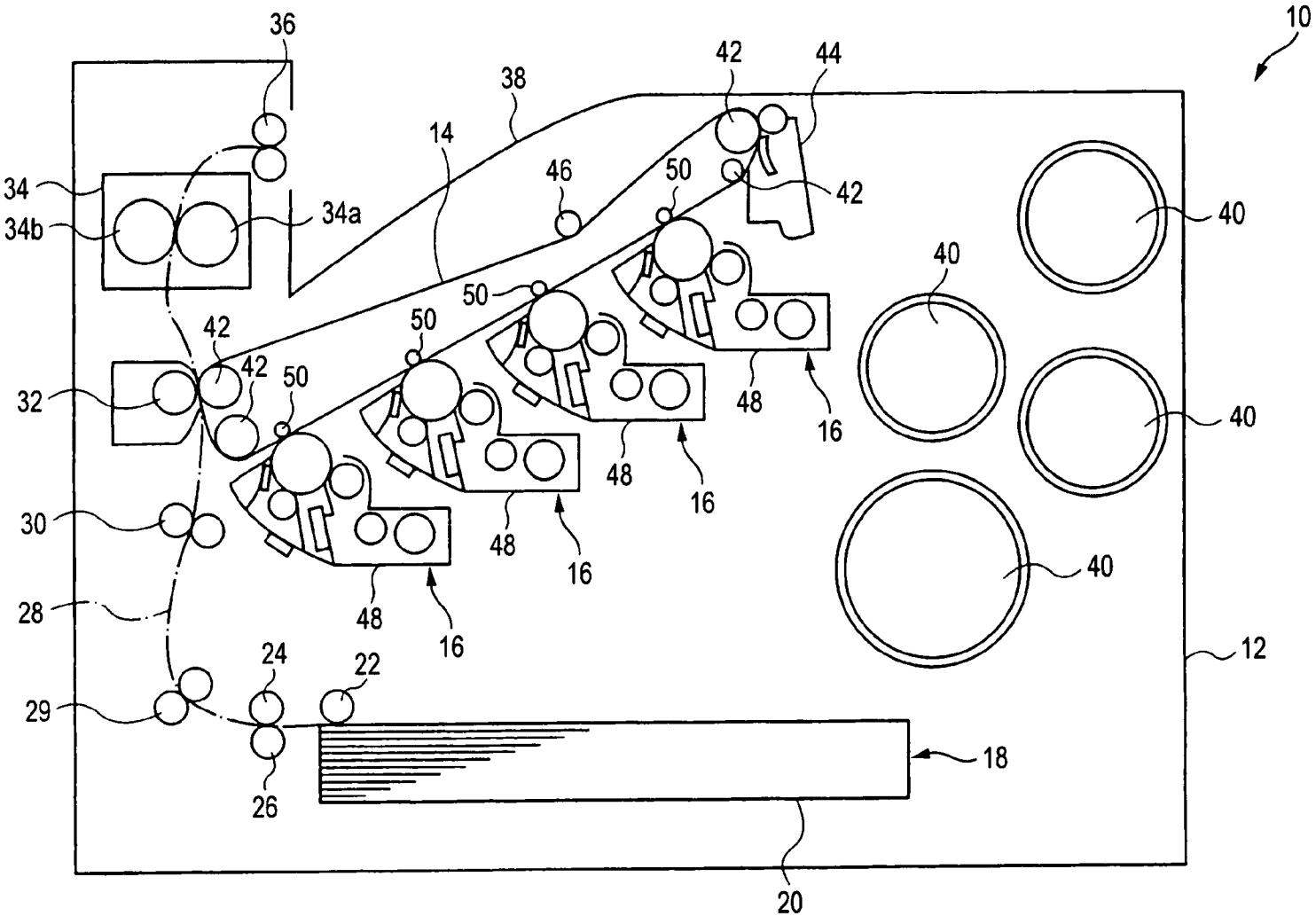
FIG. 1 is a side view showing an image forming apparatus according to the first exemplary embodiment of the invention.

FIG. 1 shows an image forming apparatus 10 according to an exemplary embodiment of the invention. The image forming apparatus 10 has an image forming apparatus main unit 12, and in the image forming apparatus main unit 12, an intermediate transfer belt 14 is disposed. For this intermediate transfer belt 14, for example, four image forming devices 16 are disposed parallel to one another; thus, the image forming apparatus 10 forms a so-called tandem type. The image forming devices 16 form toner images of respective colors, yellow, magenta, cyan, and black, on the intermediate belt 14.

A sheet feeding device 18 is provided in a lower portion of the image forming apparatus main unit 12. The sheet feeding device 18 has a sheet feeding cassette 20 to which sheets are loaded, a pickup roll 22 for picking up a sheet that has been loaded in this sheet feeding cassette 20, and a feed roll 24 and a retard roll 26 for sending out the sheets while separating them. The sheet feeding cassette 20 is provided detachably from the image forming apparatus main unit 12 in such a manner that it can be drawn out frontward in the drawing. In the sheet feeding cassette 20, sheets which are transfer sheets such as plain paper and OHP sheet, are loaded and accommodated.

A sheet feeding path 28 is provided near one end of the image forming apparatus main unit 12 (near the left end in the drawing) along a substantially vertical direction. Conveying rolls 29, resist rolls 30, a second transfer roll 32, a fixing device 34, and discharge rolls 36 are provided on this sheet feeding path 28. The resist rolls 30 temporarily holds the sheet that has been sent out to the sheet feeding path 28, and sends it to the second transfer roll 32 with proper timing. The fixing device 34 includes a heating roll 34*a* and a pressure roll 34*b* that apply heat and pressure to the sheet that is passing through the heating roll 34*a* and the pressure roll 34*b* to fix a toner image onto the sheet.

A discharge tray part 38 is provided at the upper portion of the image forming apparatus main unit 12. The sheet on which a toner image has been fixed is discharged by the above-mentioned discharge rolls 36 onto the discharge tray part 38, and is stacked on the discharge tray part 38. Thus, the sheets in the sheet feeding cassette 20 are passed through the C-shaped path one after another and are discharged to the discharge tray part 38.

Four toner bottles 40, for example, are provided in the other end portion of the image forming apparatus main unit 12 (in the right end portion in the drawing). The toner bottles 40 accommodate toners of yellow, magenta, cyan, and black, respectively. The toner bottles 40 are configured to feed the toners to the image forming devices 16 via toner feeding paths, which are not shown in the drawing.

The intermediate transfer belt 14 is supported by plural conveying rolls 42, and the belt surface on which the above-described image forming devices 16 are provided is tilted with respect to a horizontal direction. One of the conveying rolls 42 forms a backup roll of the second transfer roll 32. An intermediate belt cleaning device 44 is disposed in the vicinity of the upper end of the intermediate transfer belt 14, and another one of the conveying rolls 42 forms a backup roll of the cleaning device 44. In addition, a tension roll 46 is arranged above the intermediate transfer belt 14 so that an appropriate tension is applied to the intermediate transfer belt 14 by this tension roll 46.

Each of the image forming devices 16 includes an image forming unit 48 that face one surface of the intermediate transfer belt 14, and a first transfer roll 50 provided on the back surface of the intermediate transfer belt 14. The image forming unit 48 is freely detachable from the image forming apparatus main unit 12, so that it can be drawn out frontward in the figure.

Figure 2:
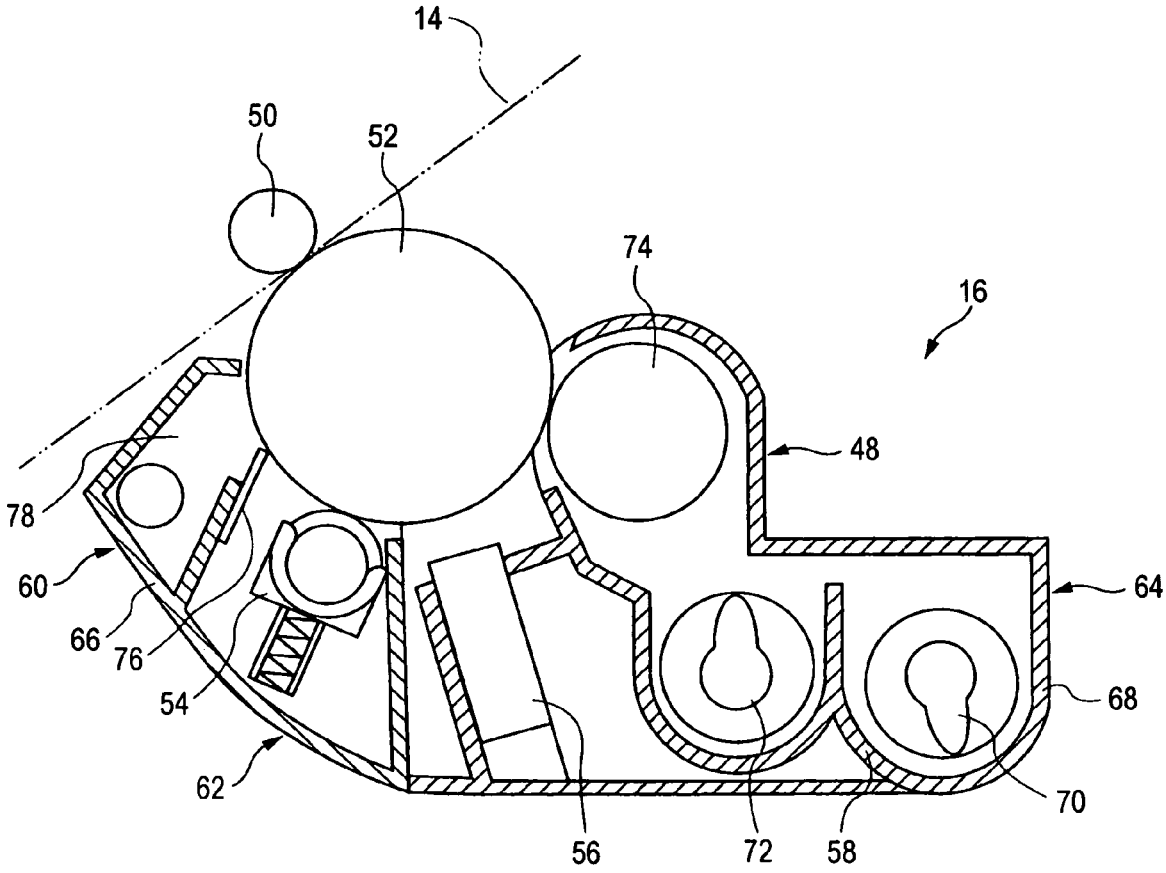
FIG. 2 is a side view showing an image forming device used for the image forming apparatus according to the first exemplary embodiment of the invention.

FIG. 2 shows the details of each the image forming devices 16. The image forming unit 48 has: a photosensitive drum 52 facing the intermediate transfer belt 14; a charging device 54 that charges the photosensitive drum 52 comprising for example, a roll; an exposing device 56 that forms a latent image on the photosensitive drum 52 comprising for example, an LED (light emitting diode); a developing device 58 that develops the latent image formed on the photosensitive drum 52 by the exposing device 56 using a toner; and a cleaning device 60 that removes the toner remaining on the photosensitive drum 52 after the transfer. In this exemplary embodiment, the image forming unit 48 is constructed by coupling a photosensitive drum unit 62 and a developing unit 64, which can be disassembled. In the photosensitive drum unit 62, the photosensitive drum 52, the charging device 54, the exposing device 56, and the cleaning device 60 are accommodated in a first housing 66. In the developing unit 64, the developing device 58 is accommodated within a second housing 68. The first housing 66 and the second housing 68 are detachably coupled to form the image forming unit 48.

The developing device 58 adopts, for example, a two-component system, and uses a developing agent comprising a toner and a carrier. The device has, for example, two augers 70 and 72 disposed horizontally parallel to each other, and a developing roll 74 disposed diagonally above the discharging-side auger 72. The augers 70 and 72 stir the developing agent and feed it to the developing roll 74. A magnetic brush originating from the carrier is formed on the developing roll 74, and by this magnetic brush, the toner adhering to the carrier is conveyed so that the latent image on the photosensitive drum 52 is developed by the toner. Since the developing roll 74 is disposed above the augers 70 and 72 in the two-component system developing device 58 as in this exemplary embodiment, the developing agent is prevented from gathering and the developing agent can be stirred uniformly, whereby the development performance can be maintained.

The cleaning device 60 includes a toner scraping-off part 76 comprising for example, a blade, and a collecting part 78 for collecting the toner that has been scraped off by the toner scraping-off part 76.

In the above-described configuration, the intermediate transfer belt 14 and the photosensitive drum 52 rotate in synchronization with each other in opposite directions. The surface of the photosensitive drum 52 is charged by the charging device 54, and a latent image is formed by the exposing device 56. This latent image on the photosensitive drum 52 which has been formed by the exposing device 56 is developed by the developing device 58. The toner image developed by the developing device 58 is transferred onto the intermediate transfer belt 14 by the first transfer roll 50. The toner images of different colors formed by the respective image forming devices 16 are overlapped while the intermediate transfer belt 14 is moving.

Meanwhile, the sheets stacked in the sheet feeding cassette 20 of the sheet feeding device 18 are fed one by one to the sheet feeding path 28 by the pickup roll 22, the feed roll 24, the retard roll 26, and so forth. The sheet fed to the sheet feeding path 28 is brought into contact with the resist rolls 30, where it is held temporarily, and is then sent to the second transfer roll 32 with appropriate timing. Then, the toner image on the intermediate transfer belt 14 is transferred to the sheet by this second transfer roll 32. The sheet on which the toner image has been transferred is further sent to the fixing device 34, where the toner image is fixed to the sheet by means of heat and pressure. The sheet on which the toner image has been fixed by the fixing device 34 is discharged to the discharge tray part 38 by the discharge rolls 36.

Such a tandem-type image forming apparatus 10 tends to be large in size because, for example, four image forming devices 16 are lined up along the intermediate transfer belt 14. In this exemplary embodiment, size reduction is achieved by tilting the intermediate transfer belt 14 with respect to the horizontal direction and optimizing the layout of the plural image forming devices 16 relative to one another.

Figure 3:
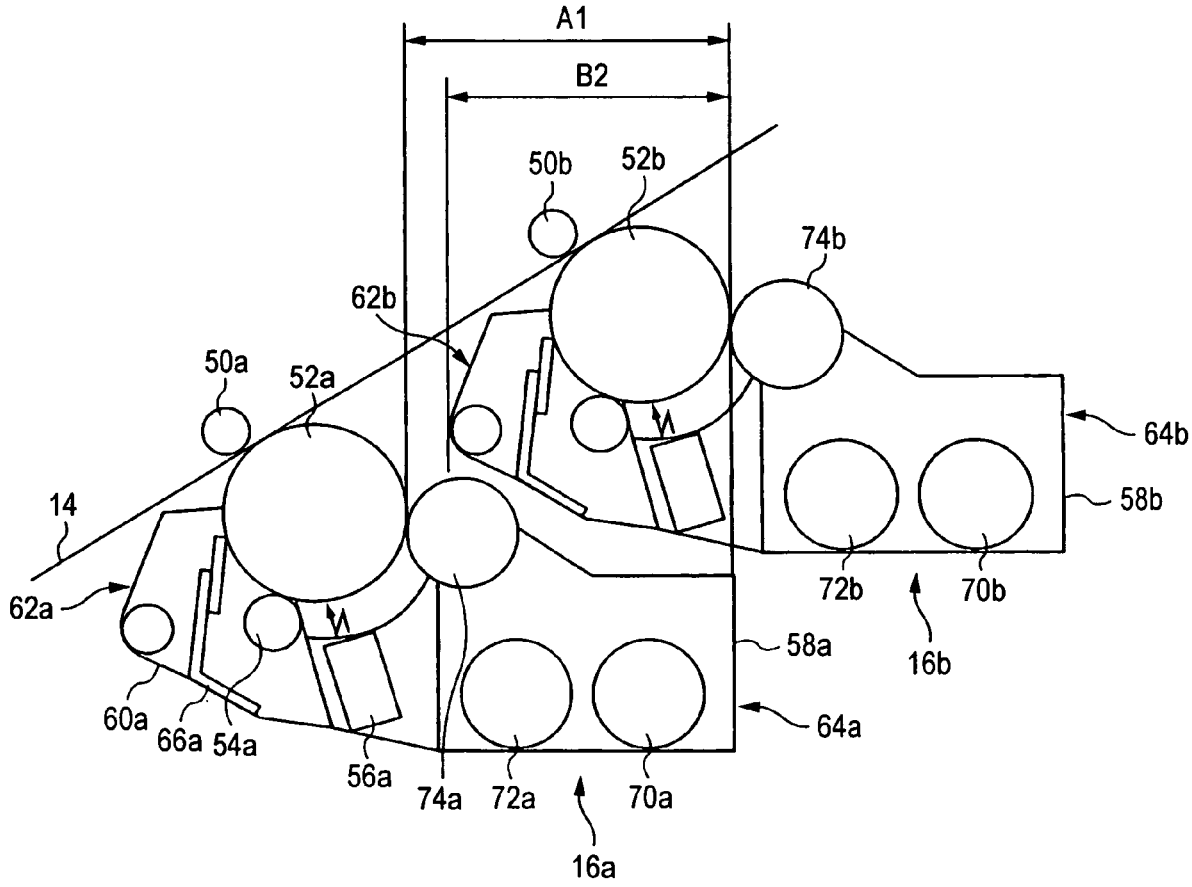
FIG. 3 is a side view showing the positional relationship between image forming devices used in the first exemplary embodiment of the invention.

FIG. 3 shows the positional relationship between the plural image forming devices 16. In FIG. 3, the constituent components of a first image forming device 16*a* are denoted by suffixing "a" to the reference numerals, and the constituent components of a second image forming device 16*b*, which is disposed adjacent to and above the first image forming device 16*a*, are denoted by suffixing "b" to the reference numerals. In this exemplary embodiment, a photosensitive drum unit 62*b* of the second image forming device 16*b* is disposed vertically above a developing device 58*a* of the first image forming device 16*a* so that a horizontal width B2 of the photosensitive drum unit 62*b* comes within a horizontal width A1 of a developing device 58*a* of the first image forming device 16*a*. Thus, a photosensitive drum 52*b*, a charging device 54*b*, an exposing device 56*b*, and a cleaning device 60*b* of the second image forming device 16*b* are disposed vertically above the first image forming device 16*a*. Therefore, the apparatus is made compact corresponding to the size of the overlap. In this exemplary embodiment, the whole of the photosensitive drum unit 62*b* is vertically overlapped with the developing device 52*a*; however, only portions of the photosensitive drum 52*b*, the charging device 54*b*, and the exposing device 56*b* may be vertically overlapped with the developing device 58*a*.

In addition, a first transfer roll 50*b* of the second image forming device 16*b* is disposed vertically above the developing device 58*a* of the first image forming device 16*a* so that the first transfer roll 50*b* of the second image forming device 16*b* comes within the horizontal width A of the developing device 58*a* of the first image forming device 16*a*. In this exemplary embodiment, the whole of the first transfer roll 50*b* is vertically overlapped with the developing device 58*a*; however, only a portion of the first transfer roll 50*b* may be vertically overlapped with the developing device 58*a*.

Figure 4:
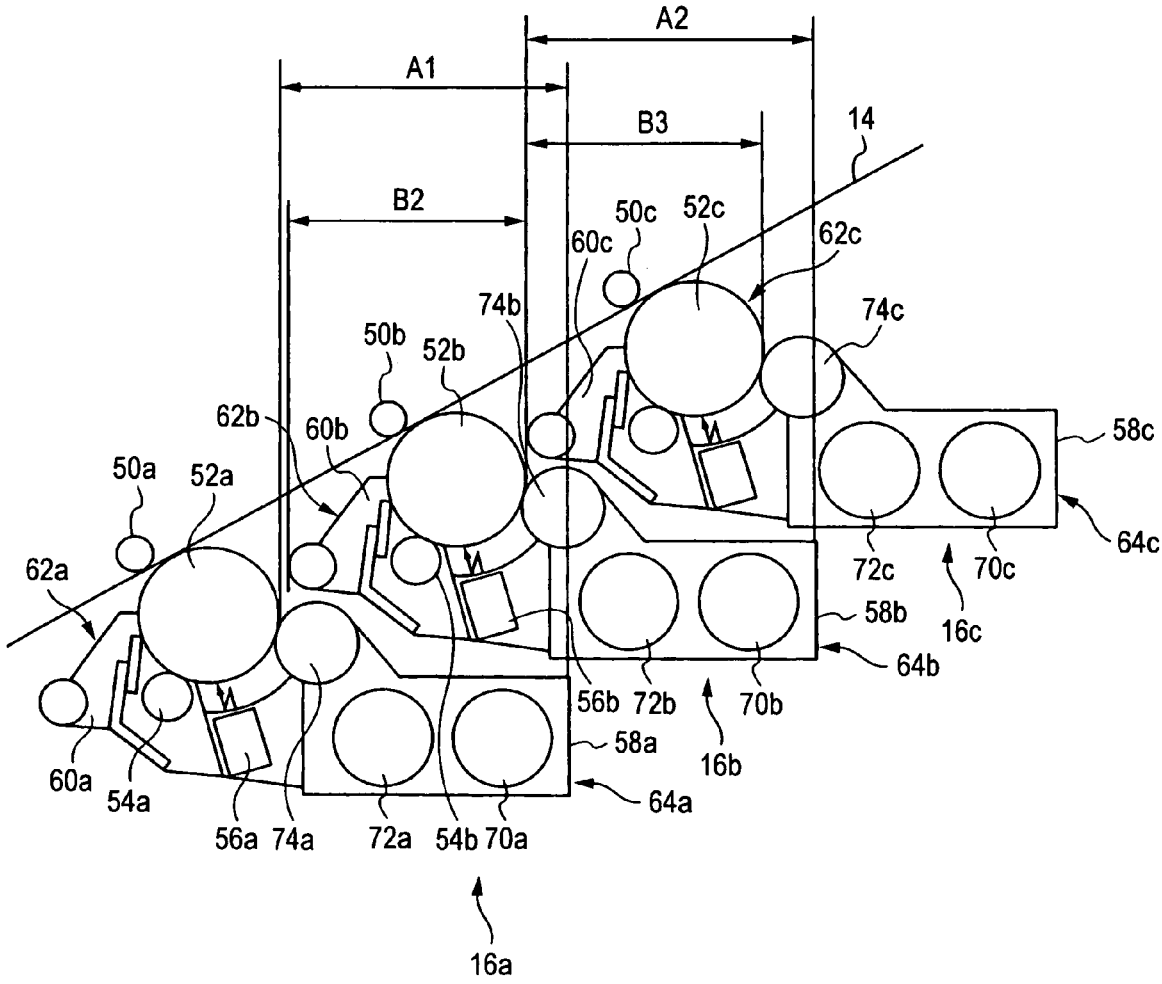
FIG. 4 is a side view showing the positional relationship between image forming devices used in the second exemplary embodiment of the invention.

FIG. 4 shows another exemplary embodiment. In FIG. 4, the constituent components of the first image forming device 16*a* are denoted by suffixing "a" to the reference numerals, the constituent components of the second image forming device 16*b*, which is disposed adjacent to and above the first image forming device 16*a*, are denoted by suffixing "b" to the reference numerals. The constituent components of a third image forming device 16*c*, which is disposed adjacent to and above the second image forming device 16*a*, are denoted by suffixing "c" to the reference numerals.

In this exemplary embodiment, the horizontal width B2 of the photosensitive drum unit 62*b* of the second image forming device 16*b* comes within the horizontal width A1 of the developing device 58*a* of the first image forming device 16*a*. Moreover, a portion of a horizontal width B3 of a photosensitive drum unit 62*c* of the third image forming device 16*c* also comes within the horizontal width A1. In other words, the whole of the photosensitive drum unit 62*b* and the first transfer roll 50*b* of the second image forming device 16*b*, and a portion of the cleaning device 60*c* that is a portion of the photosensitive drum unit 62*c* of the third image forming device 16*c*, are disposed vertically within the horizontal width A1 of the developing device 58*a* of the first image forming device 16*a*. Therefore, in this exemplary embodiment, the apparatus is made even more compact than the previously-described exemplary embodiment.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a belt;

a plurality of photosensitive drums that face the belt;

a plurality of developing devices that develop a plurality of latent images formed on the plurality of photosensitive drums using a developing agent, the developing devices being disposed around the respective photosensitive drums;

a plurality of image forming devices, each one of the plurality of image forming devices comprising one of the plurality of photosensitive drums and one of the plurality of developing devices, and the photosensitive drum of an adjacent one of the plurality of image forming devices being disposed vertically within a horizontal width of the developing device of one of the plurality of image forming devices; and a plurality of exposing devices that form the plurality of latent images on the plurality of photosensitive drums, the exposing devices being disposed around the respective photosensitive drums, wherein each developing device includes two augers and a developing roll, the two augers stirring the developing agent and feeding the developing agent to the developing roll, the developing roll facing the photosensitive drum corresponding to each developing device, the developing roll being provided at a higher level than the two augers and being separate from the two augers, each one of the plurality of image forming devices comprises one of the plurality of photosensitive drums, one of the plurality of exposing devices, and one of the plurality of developing devices, and an entirety of the photosensitive drum and at least a portion of the exposing device of an adjacent one of the plurality of image forming devices are disposed vertically within the horizontal width of the developing device of one of the plurality of image forming devices.

2. The image forming apparatus according to claim 1 further comprising:

a plurality of charging devices that charge the plurality of photosensitive drums, the charging devices being disposed around the respective photosensitive drums, wherein each one of the plurality of image forming devices comprises one of the plurality of photosensitive drums, one of the plurality of charging devices, and one of the plurality of developing devices, and an entirety of the photosensitive drum and at least a portion of the charging device of an adjacent one of the plurality of image forming devices are disposed vertically within the horizontal width of the developing device of one of the plurality of image forming devices.

3. The image forming apparatus according to claim 2, further comprising:

a plurality of transfer devices that transfer developed latent images formed on the plurality of photosensitive drums, the transfer devices being disposed on an opposite side of the respective photosensitive drums with respect to the belt, wherein each one of image forming devices comprises one of the plurality of photosensitive drums, one of the plurality of charging devices, one of the plurality of developing devices, and one of the plurality of transfer devices, and an entirety of the photosensitive drum, at least a portion of the charging device, and at least a portion of the transfer device of an adjacent one of the plurality of image forming devices are disposed vertically within a horizontal width of the developing device of one of the plurality of image forming devices.

4. The image forming apparatus according to claim 1, further comprising:

a plurality of transfer devices that transfer developed latent images formed on the plurality of photosensitive drums, the transfer devices being disposed on an opposite side of the respective photosensitive drums with respect to the belt, wherein each one of the plurality of image forming devices comprises one of the plurality of photosensitive drums, one of the plurality of developing devices, and one of the plurality of transfer devices, and an entirety of the photosensitive drum and at least a portion of the transfer device of an adjacent one of the plurality of image forming devices are disposed vertically within a horizontal width of the developing device of one of the plurality of image forming devices.

5. The image forming apparatus according to claim 1, further comprising:

a plurality of cleaning devices that remove the developing agent remaining on the plurality of photosensitive drums, the cleaning devices being disposed around the respective photosensitive drums, wherein each one of image forming devices comprises one of the plurality of photosensitive drums, one of the plurality of developing devices, and one of the plurality of cleaning devices, and an entirety of the photosensitive drum and at least a portion of the cleaning device of an adjacent one of the plurality of image forming devices are disposed vertically within a horizontal width of the developing device of one of the plurality of image forming devices.

6. An image forming apparatus comprising:

a belt;

a plurality of photosensitive drums that face the belt;

a plurality of exposing devices that form a plurality of latent images on the plurality of photosensitive drums, the exposing devices being disposed around the respective photosensitive drums;

a plurality of developing devices that develop the plurality of latent images formed on the plurality of photosensitive drums using a developing agent; and a plurality of image forming devices, each one of the plurality of image forming devices comprising one of the plurality of photosensitive drums, one of the plurality of exposing devices, and one of the plurality of developing devices, and at least a portion of the exposing device of an adjacent one of the plurality of image forming devices being disposed vertically within a horizontal width of the developing device of one of the plurality of image forming devices, wherein each developing device includes two augers and a developing roll, the two augers stirring the developing agent and feeding the developing agent to the developing roll, the developing roll facing the photosensitive drum corresponding to each developing device, the developing roll being provided at a higher level than the two augers and being separate from the two augers.

7. The image forming apparatus according to claim 6, further comprising:

a plurality of charging devices that charge the plurality of photosensitive drums, the charging devices being disposed around the respective photosensitive drums, wherein each one of image forming devices comprises one of the plurality of photosensitive drums, one of the plurality of charging devices, and one of the plurality of developing devices, and at least a portion of the charging device and at least a portion of the exposing device of an adjacent one of the plurality of image forming devices are disposed vertically within a horizontal width of the developing device of one of the plurality of image forming devices.

8. The image forming apparatus according to claim 6, further comprising:

a plurality of transfer devices that transfer developed latent images formed on the plurality of photosensitive drums, the transfer devices being disposed on an opposite side of the respective photosensitive drums with respect to the belt, wherein each one of image forming devices comprises one of the plurality of photosensitive drums, one of the plurality of exposing devices, one of the plurality of developing devices, and one of the plurality of transfer devices, and at least a portion of the exposing device and at least a portion of the transfer device of an adjacent image forming devices are disposed vertically within a horizontal width of the developing device of one of the plurality of image forming devices.

9. An image forming apparatus comprising:

a belt;

a plurality of photosensitive drums that face the belt;

a plurality of developing devices that develop a plurality of latent images formed on the plurality of photosensitive drums using a developing agent, the developing devices being disposed around the respective photosensitive drums;

a plurality of transfer devices that transfer developed latent images formed on the plurality of photosensitive drums, the transfer devices being disposed on an opposite side of the respective photosensitive drums with respect to the belt;

a plurality of image forming devices, each one of a plurality of image forming devices comprising one of the plurality of photosensitive drums, one of the plurality of developing devices, and one of the plurality of transfer devices, and at least a portion of the transfer device of an adjacent one of the plurality of image forming devices being disposed vertically within a horizontal width of the developing device of one of the plurality of image forming devices;

a plurality of charging devices that charge the plurality of photosensitive drums, the charging devices being disposed around the respective photosensitive drums; and a plurality of exposing devices that form a plurality of latent images on the plurality of photosensitive drums, the exposing devices being disposed around the respective photosensitive drums, wherein each developing device includes two augers and a developing roll, the two augers stirring the developing agent and feeding the developing agent to the developing roll, the developing roll facing the photosensitive drum corresponding to each developing device, the developing roll being provided at a higher level than the two augers and being separate from the two augers, each one of image forming devices comprises one of the plurality of photosensitive drums, one of the plurality of charging devices, one of the plurality of developing devices, and one of the plurality of transfer devices, at least a portion of the charging device and at least a portion of the transfer device of another one of the plurality of image forming devices is disposed vertically within a horizontal width of the developing device of one of the plurality of image forming devices, each one of image forming devices comprises one of the plurality of photosensitive drums, one of the plurality of charging devices, one of the plurality of exposing devices, one of the plurality of developing devices, and one of the plurality of transfer devices, and at least a portion of the charging device, at least a portion of the exposing device, and at least a portion of the transfer device of an adjacent one of the plurality of image forming devices are disposed vertically within a horizontal width of the developing device of one of the plurality of image forming devices.

* * * * *